US005575912A

United States Patent [19]

Herman et al.

[11] Patent Number: 5,575,912

[45] Date of Patent: Nov. 19, 1996

[54] SELF-DRIVEN, CONE-STACK TYPE CENTRIFUGE

[75] Inventors: Peter K. Herman; Byron A. Pardue, both of Cookeville, Tenn.

[73] Assignee: Fleetguard, Inc., Nashville, India.

[21] Appl. No.: 378,197

[22] Filed: Jan. 25, 1995

[51] Int. Cl.[6] ..... B04B 1/08

[52] U.S. Cl. ..... 210/380.1; 210/168; 184/6.24; 494/68; 494/70; 494/72; 494/73

[58] Field of Search ..... 184/6.24; 210/360.1, 210/380.1, 168, DIG. 17; 494/49, 56, 76, 79, 88, 68, 70, 72, 73

[56] References Cited

U.S. PATENT DOCUMENTS

| | | | |
|---|---|---|---|
| 955,890 | 4/1910 | Marshall . | |
| 1,006,662 | 10/1911 | Bailey | 494/75 |
| 1,038,607 | 9/1912 | Lawson . | |
| 1,136,654 | 4/1915 | Callane . | |
| 1,151,686 | 8/1915 | Hult et al. . | |
| 1,293,114 | 2/1919 | Kendrick . | |
| 1,422,852 | 7/1922 | Hall . | |
| 1,482,418 | 2/1924 | Unger . | |
| 1,525,016 | 2/1925 | Weir . | |
| 1,784,510 | 12/1930 | Berline . | |
| 2,031,734 | 2/1936 | Riebel, Jr. et al. . | |
| 2,087,778 | 7/1937 | Nelin . | |
| 2,129,751 | 9/1938 | Wells et al. . | |
| 2,302,381 | 11/1942 | Scott . | |
| 2,321,144 | 6/1943 | Jones . | |
| 2,578,485 | 12/1951 | Nyrop . | |
| 2,752,090 | 6/1956 | Kyselka et al. . | |
| 2,755,017 | 7/1956 | Kyselka et al. . | |
| 3,036,759 | 5/1962 | Bergner . | |

(List continued on next page.)

FOREIGN PATENT DOCUMENTS

| | | |
|---|---|---|
| 1079699 | 6/1980 | Canada . |
| 1275728 | 10/1961 | France . |
| 229647 | 2/1926 | United Kingdom . |
| 812047 | 4/1959 | United Kingdom . |
| 1089355 | 11/1967 | United Kingdom . |
| 1507742 | 4/1978 | United Kingdom . |
| 2049494 | 12/1980 | United Kingdom . |

OTHER PUBLICATIONS

Theodore De Loggio and Alan Letki, "New Directions in Centrifuging", *Chemical Engineering*, pp. 70–76, Jan., 1994.

Spinner II® product brochure, T. G. Hudgins, Incorporated, 1985.

"Theory of Separation", Alfa Laval Separation AB, pp. 1–8.

*Primary Examiner*—David A. Reifsnyder

*Attorney, Agent, or Firm*—Woodard, Emhardt, Naughton Moriarty & McNett

[57] ABSTRACT

A bypass circuit centrifuge for separating particulate matter out of a circulating liquid includes a hollow and generally cylindrical centrifuge bowl which is arranged in combination with a base plate so as to define a liquid flow chamber. A hollow centertube axially extends up through the base plate into the hollow interior of the centrifuge bowl. The bypass circuit centrifuge is designed so as to be assembled within a cover assembly and a pair of oppositely disposed tangential flow nozzles in the base plate are used to spin the centrifuge within the cover so as to cause particles to separate out from the liquid. The interior of the centrifuge bowl includes a plurality of truncated cones which are arranged into a stacked array and are closely spaced so as to enhance the separation efficiency. The stacked array of truncated cones is sandwiched between a top plate positioned adjacent to the top portion of the centrifuge bowl and a bottom plate which is positioned closer to the base plate. The incoming liquid flow exits the centertube through a pair of oil inlets and from there flows through the top plate. The top plate in conjunction with ribs on the inside surface of the centrifuge bowl accelerate and direct this flow into the upper portion of the stacked array of truncated cones. As the flow passes through the channels created between adjacent cones, particle separation occurs as the liquid continues to flow downwardly to the tangential flow nozzles.

28 Claims, 7 Drawing Sheets

U.S. PATENT DOCUMENTS 3,990,631 11/1976 Schall .
4,067,494 1/1978 Willus et al. .
4,106,689 8/1978 Kozulla .
4,221,323 9/1980 Courtot .
4,230,581 10/1980 Beazley .
4,262,841 4/1981 Berber et al. .
4,288,030 9/1981 Beazley et al. .
4,346,009 8/1982 Alexander et al. .
4,400,167 8/1983 Beazley et al. .
4,498,898 2/1985 Haggett .
4,615,315 10/1986 Graham .
4,698,053 10/1987 Stroucken .
4,787,975 11/1988 Purvey .
4,861,329 8/1989 Borgström et al. .
4,915,682 4/1990 Stroucken .
4,961,724 10/1990 Pace .
5,052,996 10/1991 Lantz .
5,342,279 8/1994 Cooperstein .
5,354,255 10/1994 Shapiro .
5,362,292 11/1994 Borgström et al. .
5,374,234 12/1994 Madsen .

SELF-DRIVEN, CONE-STACK TYPE CENTRIFUGE

BACKGROUND OF THE INVENTION

The present invention relates generally to the continuous separation of solid particles from a liquid by the use of a centrifugal field. More particularly the present invention relates to the use of a cone (disc) stack centrifuge configuration within a self-driven centrifuge in order to achieve enhanced separation efficiency.

Diesel engines are designed with relatively sophisticated air and fuel filters (cleaners) in an effort to keep dirt and debris out of the engine. Even with these air and fuel cleaners, dirt and debris will find a way into the lubricating oil of the engine. The result is wear on critical engine components and if this condition is left unsolved or not remedied, engine failure. For this reason, many engines are designed with full flow oil filters that continually clean the oil as it circulates between the lubricant sump and engine parts.

There are a number of design constraints and considerations for such full flow filters and typically these constraints mean that such filters can only remove those dirt particles that are in the range of 10 microns or larger. While removal of particles of this size may prevent a catastrophic failure, harmful wear will still be caused by smaller particles of dirt that get into and remain in the oil. In order to try and address the concern over smaller particles, designers have gone to bypass filtering systems which filter a predetermined percentage of the total oil flow. The combination of a full flow filter in conjunction with a bypass filter reduces engine wear to an acceptable level, but not to the desired level. Since bypass filters may be able to trap particles less than approximately 10 microns, the combination of a full flow filter and bypass filter offers a substantial improvement over the use of only a full flow filter.

The desire to remove these smaller particles of dirt has resulted in the design of high speed centrifuge cleaners. One product which is representative of this design evolution is the SPINNER II® oil cleaning centrifuge made by Glacier Metal Company Ltd., of Somerset, Ilminister, United Kingdom, and offered by T. F. Hudgins, Incorporated, of Houston, Tex. The following description of the SPINNER II® product is taken directly from a product brochure copyrighted in 1985 and published by T. F. Hudgins, Incorporated:

> Now there is SPINNER II®. It is a true high-speed centrifuge that removes dense, hard, abrasive particles as tiny as 0.1 micron. That's 400 times smaller than the dirt removed by your full-flow filter. And because the SPINNER II® is a real centrifuge that slings dirt out of the path of circulating oil, it maintains a constant flow throughout its operating cycle. In fact, tests show that the SPINNER II® unit is so good, it reduces engine wear half-again as much as even the best full-flow/bypass filter combination.
>
> Best of all, the SPINNER II® oil cleaning centrifuge is low-cost because it is powered only by the engine's own oil pressure: less than five percent of the cost of-the traditional electric-motor-driven centrifuge. Now you can install the most cost-effective oil cleaning system with the best wear reduction available today—on all your industrial engines.

The construction and operating theory of the SPINNER II® oil cleaning centrifuge is described in the foregoing publication in the following manner:

> The SPINNER II® oil cleaning centrifuge consists of three sections—the centrifuge bowl, the driving turbine and the oil—level control mechanism—all contained in a rugged steel and cast aluminum housing.
>
> To get to the centrifuge, dirty oil from the engine enters the side of the SPINNER II® housing and travels up through the hollow spindle. At the top of the spindle, a baffle distributes the oil uniformly into the centrifuge bowl. Because the bowl spins at about 7500 rpm, the oil quickly accelerates to a high speed. The resulting centrifugal force slings dirt outwardly onto the bowl wall where it mats into a dense cake.
>
> Clean oil leaves the bowl through the screen and enters the turbine section. Here the engine's oil pressure expels the oil through two jets that spin the turbine and attached centrifuge bowl. Oil pressure alone drives this highly efficient unit.

While the SPINNER II® might seem to be the complete answer to the task of effective oil filtration and cleaning, there are other high-speed centrifuge designs. There are also design shortcomings with the SPINNER II® from the standpoint of filtering or cleaning efficiency. First, with regard to other high-speed centrifuge designs, the SPINNER II® literature makes reference to other high-speed, electric-motor-driven centrifuges, such as those made by Alfa Laval, Bird, and Westphalia. As stated by the SPINNER II® literature, these motor-driven centrifuges are "too expensive (upwards of $10,000) and too complex for general use".

With regard to the aforementioned design inefficiencies of the SPINNER II®, FIG. 1 represents a diagrammatic, cross-sectional view of the type of self-driven centrifuge which is similar to or representative of the SPINNER II® design. All components shown in the FIG. 1 drawing rotate upon a shaft which provides pressurized oil to the inlet ports of the centertube. After passing through the two inlet ports of the rotating spindle or tube, the oil is directed towards the top of the shell (bowl) by the top baffle. The oil then spills over the baffle and short circuits directly toward the outlet screen, leaving a majority of the centrifuge body in a completely stagnant condition. This result is unfortunate because the centrifugal force increases proportionately with distance from the axis and in this design, the flow stays very close to the axis. After passing the outlet screen, the oil passes underneath the bottom baffle plate and exits through two tangential directed nozzles which also serve to limit the oil flow rate through the centrifuge. The high velocity jets exiting the two nozzles generate the reaction torque needed to drive the centrifuge at sufficiently high rotation speeds for particle separation (3000–6000 rpm).

As stated in the SPINNER II® product literature, there are other high speed centrifuges, including electric-motor-driven designs such as those made by Alfa Laval. Besides being motor-driven, the Alfa Laval design is appropriate to consider relative to the present invention for its use of a disc-stack assembly. The disc inserts which comprise the heart of the disc-stack assembly enable the sedimentation height to be reduced, thereby resulting in greater filtering efficiency. The disc inserts are conical in shape and are assembled with circular or long rectangular plates known as caulks which are fitted between adjacent disc inserts. Separation channels are formed as a result and the thickness of the caulks may be varied so as to adjust the height of the separation channel for the particular particle size and concentration. The theory of operation and structure of the Alfa Laval disc stack separators are described in the Alfa Laval product literature and are believed to be well known to those of ordinary skill in the art. One such Alfa Laval publication is entitled "Theory of Separation" and was published by Alfa Laval Separation AB of Tumba, Sweden. Another publication with a similar disclosure or teaching was an article entitled "New Directions in Centrifuging" which was published in the January, 1994 issue of *Chemical Engineering*, pages 70–76, authored by Theodore De Loggio and Alan Letki of Alfa Laval Separation Inc.

The flow of liquid through some of the Alfa Laval disc-stack separator arrangements begins with the liquid entering at the top and flowing to the bottom where it is radially diverted and flows upwardly toward the fluid exit locations. The upward flowing liquid enters each separation channel at its outer radius edge and flows upwardly and radially inward through the channel to its point of exit at the inner radius edge. Separation of solid particles takes place as the liquid flows through the separation channels. In other Alfa Laval arrangements the flow through the disc-stack begins at an upper edge. However, in both styles the fluid exit location is at the top of the assembly.

After considering the design features and performance aspects of the centrifuge arrangements which are generally depicted by the aforementioned SPINNER II® and Alfa Laval structures, the inventors of the present invention conceived of an improved design for a bypass circuit centrifuge. Involved in the design effort by the present inventors was the use of computational fluid dynamics analysis of self-driven engine lube system centrifuges and this analysis revealed sub-optimal flow conditions from a particle separation standpoint. Additional research revealed that a greater degree of separation efficiency in a centrifuge could be achieved by using a stack of cones so as to reduce the necessary particle settling distance. However, the Alfa Laval centrifuge requires a motor-drive arrangement which represents a significant drawback from the standpoint of size, weight and cost.

What the present invention achieves is a combination of the low cost self-driven type centrifuge similar in some respects to the SPINNER II® but with the efficiency enhancement provided by a unique arrangement of stacked cones. The result is a cost effective, higher performance centrifuge which can be used to replace engine mounted disposable bypass filters. Although it was initially theorized that the self-driven centrifuge concept would not provide sufficient power to drive the stacked cone type of centrifuge, specific provisions have been made by the present invention to enable that combination in a unique and unobvious way. As conceived, the improved design of the present invention captures the lower cost benefits of the self-driven centrifuge with the greater efficiency of the disc-stack of cones. Due to the specific flow directions of the oil through the SPINNER II® and through the disc-stack configuration of the described Alfa Laval concept, a direct combination of these two designs was not possible. Specific and unique components had to be created in order to make the flow directions compatible and in order to enable a disc-stack of cones to be integrated into a self-driven bypass circuit centrifuge. According to the preferred embodiment of the present invention, a bypass circuit centrifuge is provided for maintaining cleanliness of an engine lubricant sump. The centrifuge is self-driven with system oil pressure by means of tangential nozzles and further contains a stack of closely spaced parallel truncated cones in order to increase separation efficiency. The present invention has a broader range of application than merely engine lubricants. The disclosed centrifuge can be used for a variety of fluids whenever it is desired to separate particulate matter out of a circulating flow, assuming that the necessary fluid pressure is present to drive the centrifuge.

In addition to the product literature already mentioned, there are a number of patents which disclose various filtering and centrifuge designs and advance a variety of theories as to the specific and preferred operation. The following patent references are believed to provide a representative sampling of such earlier designs and theories.

U.S. Pat. Nos.:

| PAT. NO. | PATENTEE | ISSUE DATE |
|---|---|---|
| 955,890 | Marshall | Apr. 26, 1910 |
| 1,038,607 | Lawson | Sep. 17, 1912 |
| 1,293,114 | Kendrick | Feb. 4, 1919 |
| 1,422,852 | Hall | Jul. 18, 1922 |
| 1,482,418 | Unger | Feb. 5, 1924 |
| 1,525,016 | Weir | Feb. 3, 1925 |
| 2,087,778 | Nelin | Jul. 20, 1937 |
| 2,129,751 | Wells et al. | Sep. 13, 1938 |
| 2,321,144 | Jones | Jun. 8, 1943 |
| 2,578,485 | Nyrop | Dec. 11, 1951 |
| 3,036,759 | Bergner | May 29, 1962 |
| 4,262,841 | Berber et al. | Apr. 21, 1981 |
| 4,346,009 | Alexander et al. | Aug. 24, 1982 |
| 4,106,689 | Kozulla | Aug. 15, 1978 |
| 4,787,975 | Purvey | Nov. 29, 1988 |
| 4,221,323 | Courtot | Sep. 9, 1980 |
| 4,230,581 | Beazley | Oct. 28, 1980 |
| 4,288,030 | Beazley et al. | Sep. 8, 1981 |
| 4,400,167 | Beazley et al. | Aug. 23, 1983 |
| 4,498,898 | Haggett | Feb. 12, 1985 |
| 4,615,315 | Graham | Oct. 7, 1986 |
| 4,698,053 | Stroucken | Oct. 6, 1987 |
| 4,861,329 | Borgström | Aug. 29, 1989 |
| 5,362,292 | Börgstrom et al. | Nov. 8, 1994 |
| 5,374,234 | Madsen | Dec. 20, 1994 |
| 5,342,279 | Cooperstein | Aug. 30, 1994 |
| 5,354,255 | Shapiro | Oct. 11, 1994 |

Foreign Patents:

| PATENT NO. | COUNTRY | ISSUE DATE |
|---|---|---|
| 1,507,742 | Britisih | Apr. 19, 1978 |
| 2,049,494A | Great Britain | Dec. 31, 1980 |
| 1,275,728 | France | Oct. 2, 1961 |
| 1,089,355 | Great Britain | Nov. 1, 1967 |
| 812,047 | Great Britain | Apr. 15, 1959 |
| 229,647 | Great Britain | Feb. 26, 1926 |
| 1,079,699 | Canada | Jun. 17, 1980 |

SUMMARY OF THE INVENTION

A bypass circuit centrifuge which is assembled within a cover assembly for separating particulate matter out of a circulating liquid according to one embodiment of the present invention comprises a centrifuge bowl, a base plate assembled to the centrifuge bowl, the base plate including at least one tangential flow nozzle, a hollow centertube axially extending through the base plate and through the interior of the centrifuge bowl, a top plate positioned adjacent an upper end of the centertube, a bottom plate spaced apart from the top plate and positioned closer to the base plate, and a plurality of truncated cones positioned into a stacked array which is sandwiched between the top plate and the bottom plate, the plurality of truncated cones being constructed and arranged so as to define a plurality of liquid flow paths from an outer opening to a radially inner opening, the flow paths being in flow communication with the flow nozzle.

One object of the present invention is to provide an improved bypass circuit centrifuge.

Related objects and advantages of the present invention will be apparent from the following description.

DESCRIPTION OF THE PREFERRED EMBODIMENT

Figure 1:
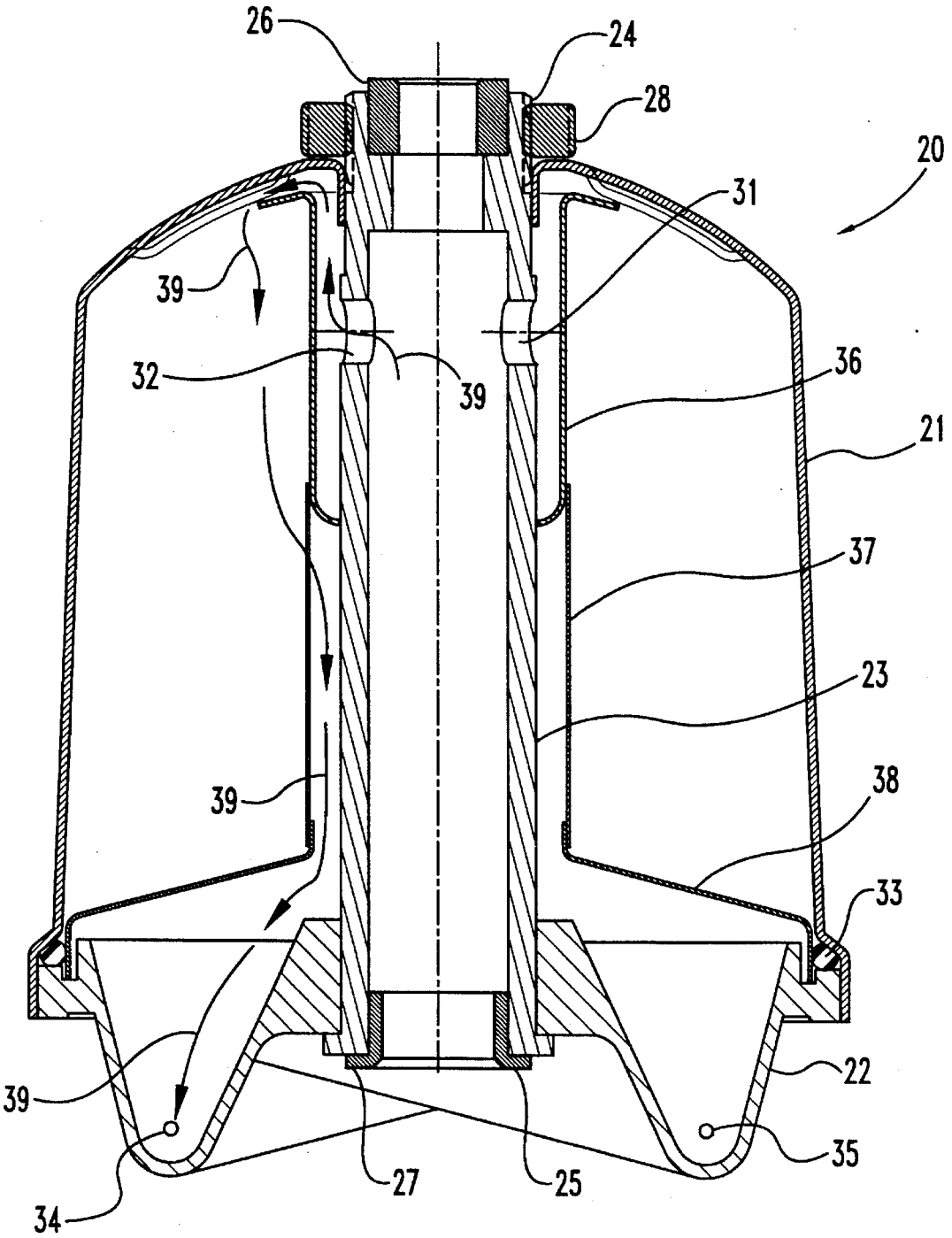
FIG. 1 (PRIOR ART)
FIG. 1 is a front elevational view in full section of a self-driven centrifuge which generally corresponds to a prior art construction.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a self-driven centrifuge 20 which is representative of the prior art construction. Centrifuge 20 includes an outer housing or centrifuge bowl 21 which is securely sealed to and around base plate 22. Bowl 21 has an open lower end and a smaller clearance opening at its upper end. Axially extending through the geometric center of plate 22 and through the interior of centrifuge bowl 21 is hollow bearing tube 23. Tube 23 is externally threaded adjacent upper end 24 and is shouldered at its lower opposite end 25. Tube 23 is fitted at each end with brass bearings 26 and 27. Nut 28 securely assembles the tube 23 to bowl 21 and plate 22. Tube 23 includes oil inlet ports 31 and 32 and annular seal 33 is positioned against the inside annular corner defined by bowl 21 and plate 22. At the lower region of plate 22 there are two tangential nozzle orifices 34 and 35. These tangential nozzles orifices are symmetrically positioned on opposite sides of the axis of the centertube 23 and their corresponding flow jet directions are opposite to one another. As a result, these flow nozzles are able to create the driving force for spinning centrifuge 20 about a center shaft within a cooperating cover assembly (not shown), as is believed to be well known in the art. It is possible to create a spinning motion with a single flow nozzle or use more than two flow nozzles. In the FIG. 1 illustration the cutting plane has been modified from a full 180 degree plane in order to show both flow nozzles.

The centrifuge 20 further includes an upper baffle 36, outlet screen 37, and bottom baffle 38. The baffles and screen are cooperatively assembled so as to help define the flow path for the liquid flowing through centrifuge 20. All components shown in FIG. 1 rotate upon a shaft (not shown) that provides pressurized oil to the oil inlet ports 31 and 32. After passing through the rotating tube inlet ports 31 and 32, the oil is directed towards the top of the bowl 21 by upper baffle 36. The oil then spills over the baffle in an outward, radial direction and short circuits directly towards the outlet screen 37 as illustrated by the flow arrows 39 provided on one side of the FIG. 1 illustration. The result of this particular flow path is that a majority of the interior of the centrifuge bowl is left in a completely stagnant condition. This fact has been revealed by computational fluid dynamics analysis. This particular drawback is a disadvantage to this self-driven design because the centrifugal force increases proportionately with the distance from the axis of rotation. In the disclosed FIG. 1 design, the liquid flow stays very close to the axis, resulting in the annular stagnant zone outwardly of the illustrated flow path.

After passing through the outlet screen 37, the oil passes beneath the bottom baffle 38 and exit through the two tangential directed nozzle, (nozzle orifices) 34 and 35. These nozzle orifices also serve to limit the oil flow rate through the centrifuge. The high velocity jet exiting from each nozzle orifice generates a reaction torque which is needed to drive the centrifuge at sufficiently high rotation speeds for particle separation (3000–6000 rpm). This rotation occurs within a cooperating cover assembly (not shown).

Figure 2:
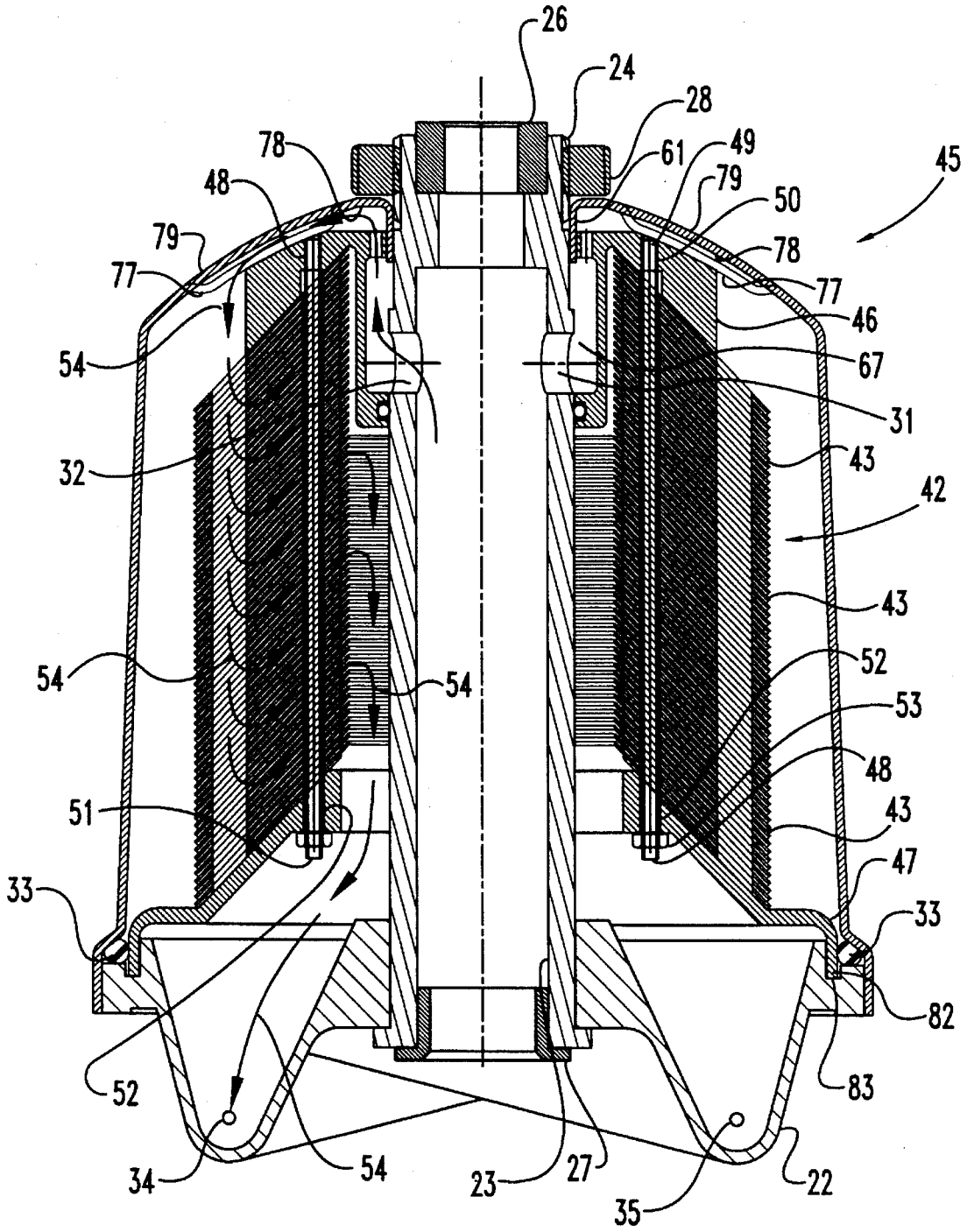
FIG. 2 is a front elevational view in full section of a bypass circuit centrifuge according to a typical embodiment of the present invention.

Referring to FIG. 2, a preferred embodiment of the present invention is illustrated and begins with several of the primary structural components of self-driven centrifuge 20. Initially it should be noted that in the FIG. 2 illustration of the present invention, the upper baffle 36, outlet screen 37, and bottom baffle 38 have been removed. To some extent these components have been replaced by different components and another significant change is that the interior of bowl 21 now receives a series or stack 42 of truncated cones 43 (see FIGS. 7 and 8) which are assembled together in a uniform and substantially parallel stack. In the preferred embodiment as illustrated, there are sixty-three (63) cones. The stack 42 of cones 43 is provided in order to create an improved centrifuge design with enhanced efficiency according to the present invention.

It is to be understood that the number of cones can increase or decrease depending on the available space for the stack, the cone wall thickness and the separation distance between adjacent cones. A significant improvement in cleaning efficiency can be achieved with only five or six cones in a stack.

Self-driven, cone-stack centrifuge 45 includes outer housing or centrifuge bowl 21 which is securely sealed to and around base plate 22. The configuration of tube 23 and its mounting provisions as illustrated in FIG. 2 are substantially the same as illustrated in FIG. 1. In addition to the series 42 of stacked-truncated cones 43, the FIG. 1 centrifuge 20 is modified by the addition of machined top plate 46 and machined bottom plate 47. Further, three equally spaced threaded rods 48 (two of which are illustrated) extend through the stack 42 of sixty-three truncated cones 43. These three threaded rods serve to help center and align the stack of truncated cones. The upper end 49 of each threaded rod 48 is received within a corresponding threaded hole 50 in machined top plate 46 (see FIGS. 3 and 4). The lower end 51 of each threaded rod 48 extends through a corresponding one of three equally spaced clearance holes 52 which are positioned in machined bottom plate 47 (see FIGS. 5 and 6). The lower end 51 of each threaded rod 48 may be secured by means of hex nuts 53 (as illustrated) or left free in the axial direction.

Figure 8:
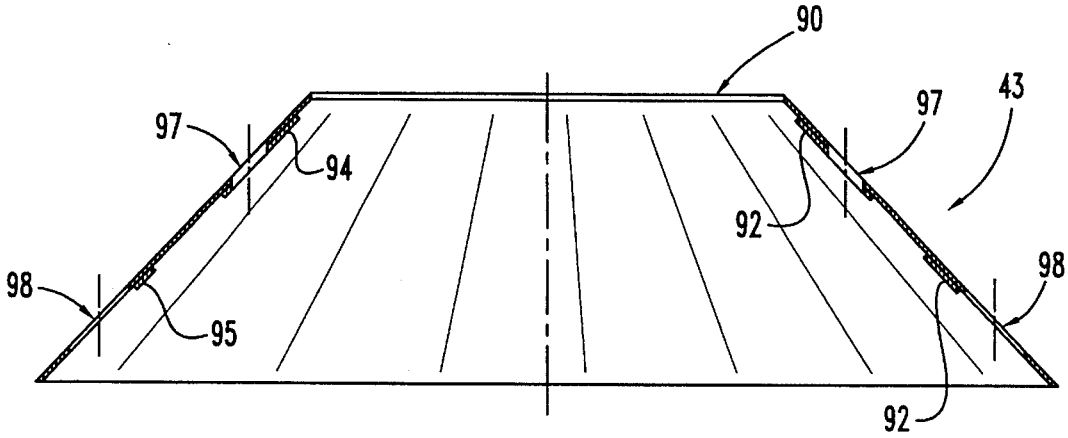
FIG. 8 (PRIOR ART)
FIG. 8 is an enlarged front elevational view in full section of the FIG. 7 truncated cone as viewed in the direction of arrows 8—8 in FIG. 7 and inverted to agree with the FIG. 2 orientation.
Figure 7:
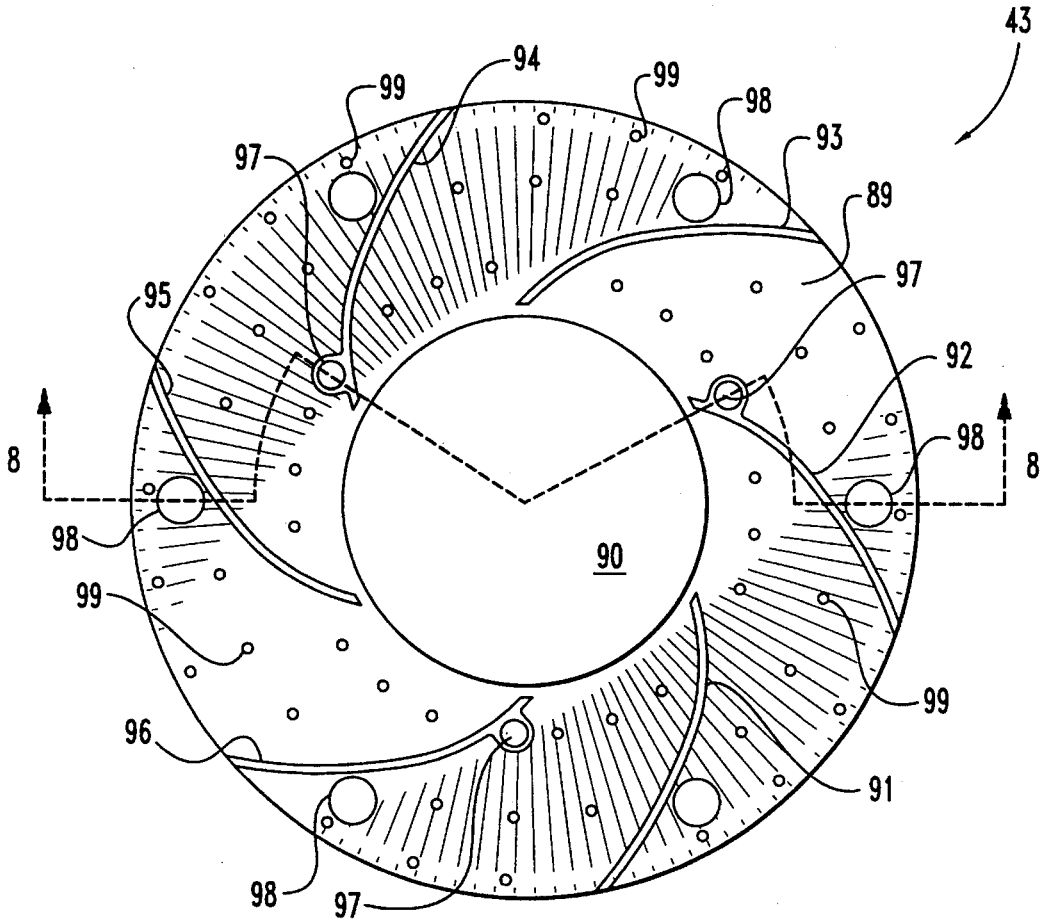
FIG. 7 (PRIOR ART)
FIG. 7 is a bottom plan view of a truncated cone which may be used as one portion of the FIG. 2 centrifuge according to the present invention, the illustrated cone generally corresponding to a prior art construction.

Each of the sixty-three cones 43 are substantially identical in construction, the details of which are illustrated in FIGS. 7 and 8. While these cones are similar to other stacked cones as to certain aspects of centrifuge separation theory, the flow direction has been changed from earlier designs. In the present invention, as depicted in FIG. 2, (note the direction of the flow arrows 54), the initial flow of liquid as it reaches stack 42 begins at the top or uppermost edge of stack 42. The flow path of the present invention is in contrast to certain styles of Alfa Laval stacked cones (reference the Background portion) wherein the initial flow begins at the bottom of the stack and moves upward through the stacked cones to a liquid exit location. Even with those Alfa Laval configurations where the flow through the stacked cones begins at the top, both the flow inlet and exits are at the top of the unit. The modified flow path of the present invention was specifically designed and configured utilizing the configuration of top plate 46 in order to utilize the liquid flow as part of a self-driven centrifuge design. The additions of Lop plate 46 and bottom plate 47 are important in order to be able to position the sixty-three truncated cones 43 in the desired and necessary orientation. Top plate 46 further contributes to the creation of the desired liquid flow direction arid creation of the desired velocity for the flow. Similarly, bottom plate 47 contributes to the flow direction of the liquid which is being separated so that the exiting flow from the stack 42 can be properly directed to the tangential flow nozzle orifices 34 and 35.

In the operation of centrifuge 45 the oil which enters through the centertube 23 is directed through oil inlet ports 31 and 32. As the oil leaves the inlet ports, it is not permitted to freely cascade over an upper baffle as in the FIG. 1 design. Instead, the oil is first directed through a plurality of annularly spaced openings in the top plate 46 and then through passages defined by depending radial ribs formed on the inside surface of the top wall of the bowl in cooperation with the top surface of the top plate. The cooperating fit between these two components serves to prevent the fluid from tangential slipping since the fluid is greatly accelerated in the tangential direction as it proceeds outwardly. Once the fluid is passed the top plate and the acceleration vanes which have been created, it turns toward the base plate and spreads out evenly between the multiple parallel gaps between adjacent cones 43. The flow then proceeds back towards the center of bowl 21. As the oil flows inward and upward, between adjacent cones 43, it is prevented from "spinning up" (i.e., acceleration in the direction of rotation) by radial vanes positioned between the cone passages which prevent tangential fluid slip. In this way the energy that was expended to accelerate the fluid on the way out is recovered on the way back. Once the fluid has passed through the cone passages, it turns toward the base plate 22 and flows under bottom plate 47 and through the flow nozzle orifices 34 and 35.

Figure 3:
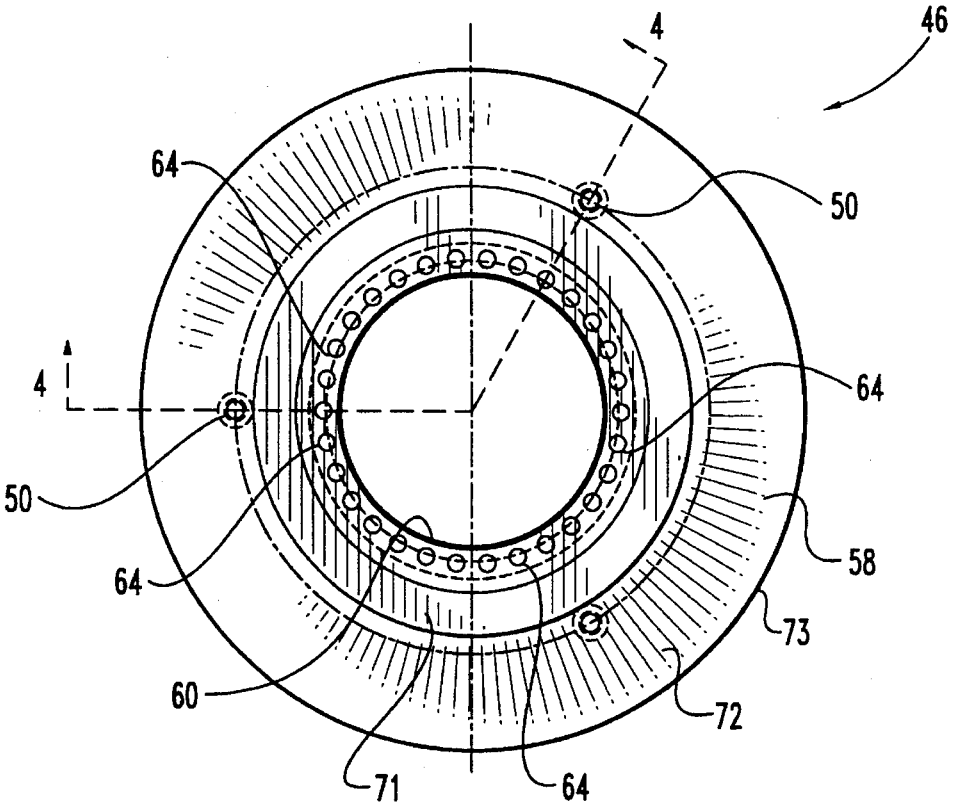
FIG. 3 is a top plan view of a top plate which comprises one component of the FIG. 2 centrifuge.
Figure 4:
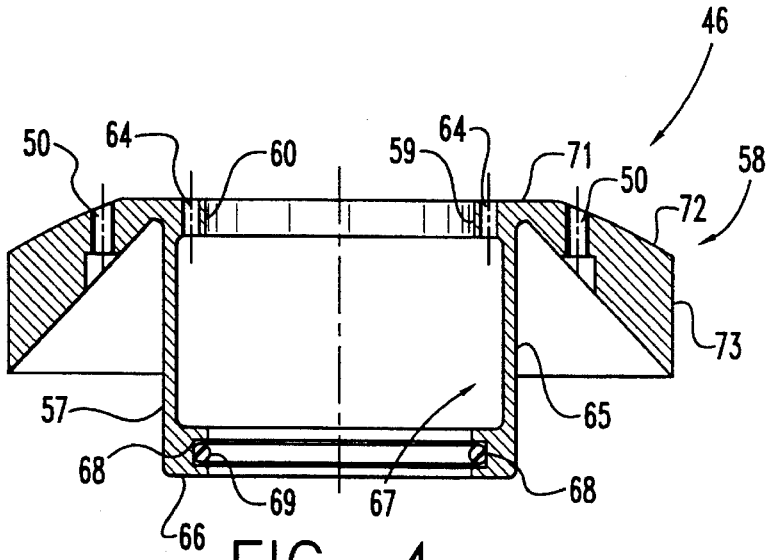
FIG. 4 is a front elevational view in full section of the FIG. 3 top plate as viewed in the direction of arrows 4—4 in FIG. 3.

Referring to FIGS. 3 and 4, the machine top plate 46 is illustrated in greater detail, including a top plan view in FIG. 3 and a front elevational view in full section in FIG. 4. Top plate 46 is a hollow annular member with a generally cylindrical lower body 57 and an annular upper flange 58 which generally increases in axial thickness as it extends radially outwardly. Inner lip 59 includes a generally cylindrical inner wall 60 which is arranged to abut up against an inner wall portion 61 of bowl 21 (see FIG. 2). Inner wall portion 61 is positioned between wall 60 and the upper end 24 of tube 23.

Inner lip 50 includes an equally spaced series of thirty (30) flow-through clearance holes 64 which provide a flow path for the liquid (oil) which exits from the oil inlet ports 31 and 32. The undercut nature of wall 65 of lower body 57 relative to lip 59 and lower flange 66 provides a clearance region 67 adjacent inlet ports 31 and 32 for directing the oil flow through clearance holes 64.

Annular lower flange 66 is arranged with an annular inner O-ring channel 68 which is fitted with an elastomeric O-ring 69. Flange 66 abuts up against the outside diameter of tube 23 immediately below the oil inlet ports 31 and 32 and in conjunction with O-ring 69 creates a liquid-tight seal at that location.

Annular upper flange 58 includes a generally horizontal top surface 71 which extends into the top surface of inner lip 59 and a spherical surface 72 which extends between surface 71 arid outer wall portion 73. Three internally threaded, axially extending holes 50 are positioned in flange 58 and extend through surface 72. The three holes are equally spaced on 120 degree centers. The internal thread pitch is the same as the external thread pitch on the upper ends 49 of rods 48.

A spaced series of inwardly or downwardly directed and radially extending ribs 77 are formed on the inside surface 78 of the curved or domed portion 79 of bowl 21 (see FIG. 2). As illustrated in FIG. 2, spherical surface 72 abuts up against these ribs 77 in order to create flow channels or vanes which are used to accelerate the liquid flow which exits from the thirty clearance holes 64.

Figure 3A:
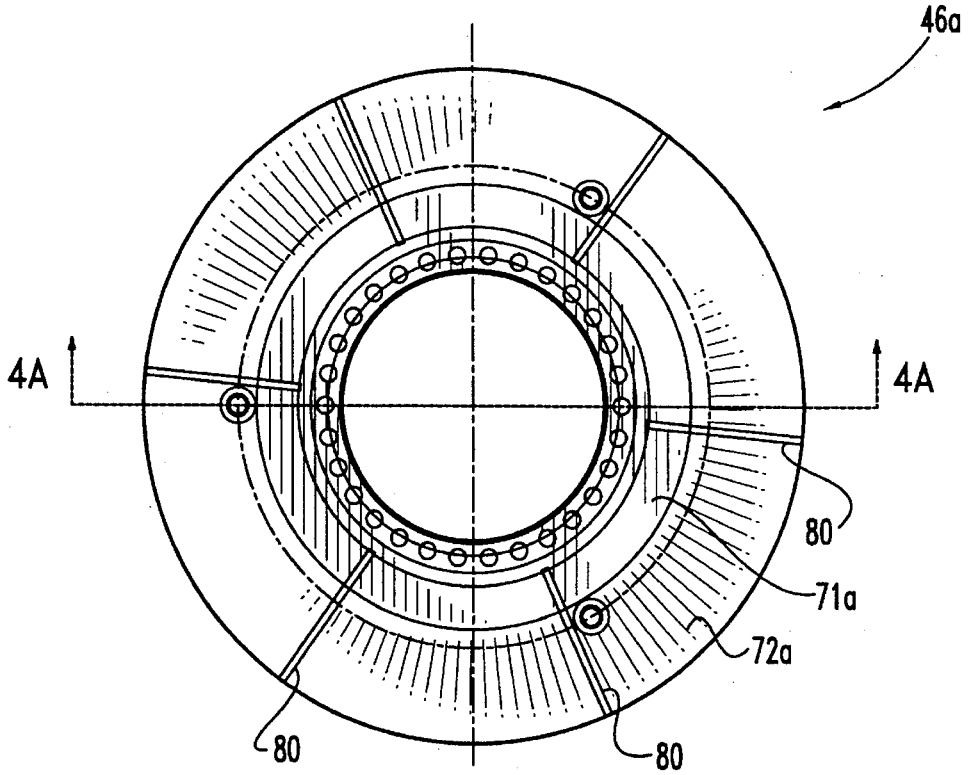
FIG. 3A is a top plan view of an alternative top plate according to the present invention.
Figure 4A:
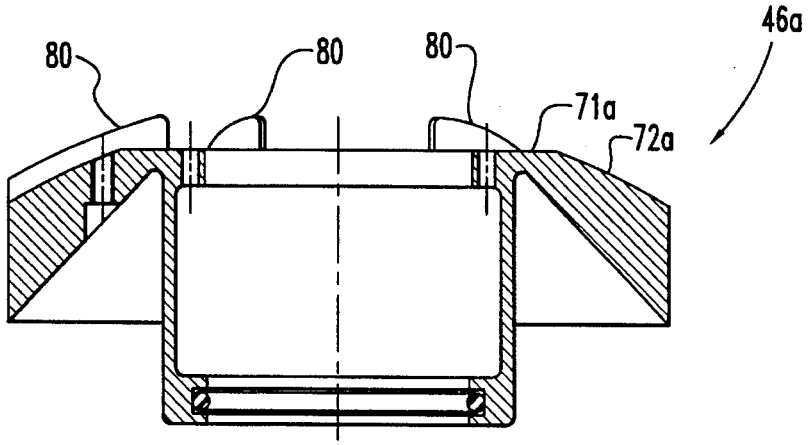
FIG. 4A is a front elevational view in full section of the FIG. 3A top plate as viewed in the direction of arrows 4A—4A in FIG. 3A.

Referring now to FIGS. 3A and 4A an alternative machined top plate **46*a* is illustrated. Top plate 46*a* is identical in all respects to top plate 46 with one exception. The spherical surface 72*a* of top plate 46*a* and a portion of surface 71*a* includes a series of outwardly radiating (straight) ribs 80. In the preferred embodiment there are a total of six ribs 80 which are equally spaced across surface 72*a*. Ribs 80 which are integrally formed as part of top plate 46*a* are designed to replace ribs 77 which are positioned on the inside surface 78 of portion 79 of bowl 21. Once ribs 77 are removed the inside surface 78 will have a smoothly curved or domed shape (spherical) and its curvature will be matched by the top surfaces of ribs 80** so that the desired flow channels (vanes) will be created.

Figure 6:
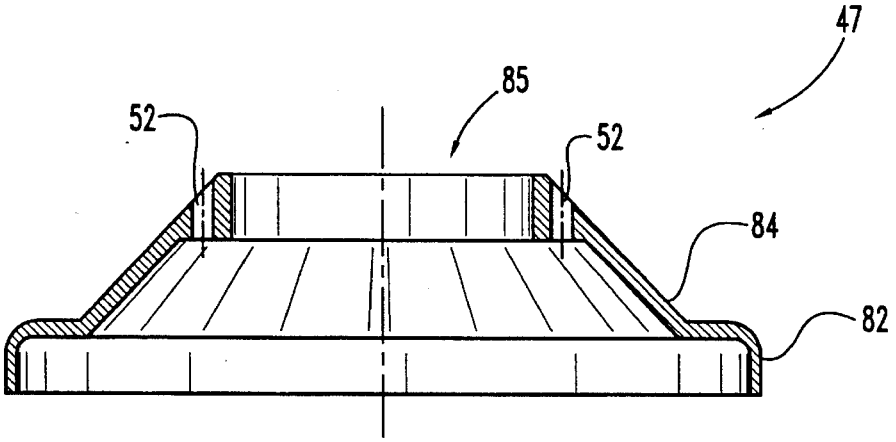
FIG. 6 is a front elevational view in full section of the FIG. 5 bottom plate as viewed in the direction of arrows 6—6 in FIG. 5.
Figure 5:
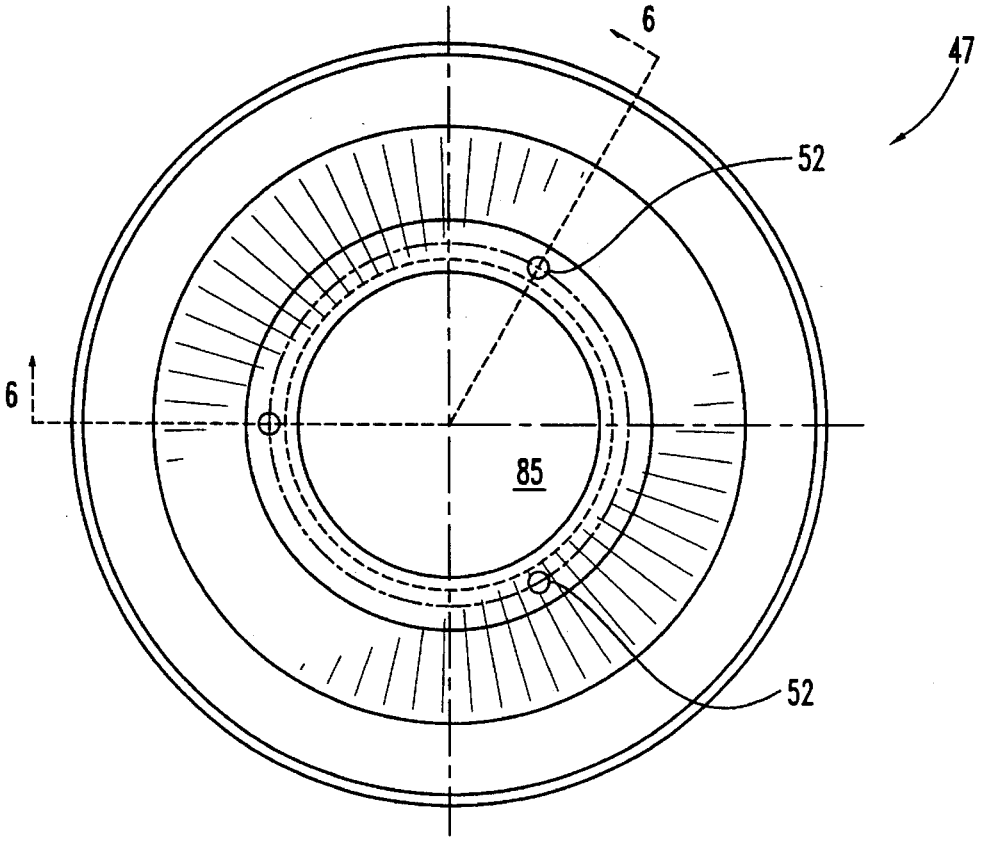
FIG. 5 is a top plan view of a bottom plate comprising one component of the FIG. 2 centrifuge according to the present invention.

Referring to FIGS. 5 and 6, the machined bottom plate 47 is illustrated in greater detail, including a top plan view in FIG. 5 and a side elevational view in full section in FIG. 6. Bottom plate 47 is hollow and has a shape which in some respects is similar to a truncated cone. Lower outer wall 82 is sized and arranged (annular) to fit into annular channel 83 which is formed into base plate 22. Outer wall 82 completes the assembled interface involving annular seal 33. Annular seal 33 is tightly wedged between bowl 21, base plate 22 and wall 82 so as to create a liquid-tight interface at that location so as to prevent any oil leakage.

Conical wall portion 84 which extends radially inwardly beyond the three equally spaced clearance holes 52 provides the support surface for the stack 42 of sixty-three cones 43. Bottom plate 47 is supported by base plate 22 and the stack 42 of cones is supported by plate 47. The remainder of the assembly (see FIG. 2) has previously been described. The inside diameter size of top opening 85 provides flow clearance relative to tube 23 for the liquid which leaves each of the cone channels (i.e., the defined spaced between adjacent cones 43). This exiting flow passes downwardly to nozzle orifices 34 and 35. These nozzles are pointed tangentially in opposite directions and use the exiting velocity of the liquid jets to spin centrifuge 20 within its associated cover assembly (not shown).

Referring to FIGS. 7 and 8, one of the sixty-three cones 43 is illustrated in greater detail, including a bottom plan view in FIG. 7 and a front elevational view in full section in FIG. 8. Note that in FIG. 8 the features on the back side inner surface have been omitted for drawing clarity, and the view has been inverted to agree with the FIG. 2 cone orientation. Each cone 43 has an inclined wall 89 which is truncated, thereby creating upper opening (inside diameter) 90. Formed on the inside surface of wall 89 are a series of six spaced, curved ribs 91–96. These curved or helical ribs can be thought of as configured into two different styles. Ribs 91, 93, and 95 have a similar shape and geometry to each other while ribs 92, 94 and 96 likewise have a similar shape and geometry to each other. While all six ribs have a similar width, length, height and curative, they differ in one respect. Ribs 92, 94 and 96 extend around mounting holes 97 which are equally spaced around wall 89. These three mounting holes 97 each receive one of the threaded rods 48. With regard to the FIG. 7 illustration, which includes the six helical ribs 91–96, the direction of cone rotation is in the clockwise direction as looking into the plane of the paper. Alternatively the six helical (curved) ribs 91–96 could be replaced with straight radial ribs 103–108 (see FIGS. 9 and 10) in which case the direction of rotation could be clockwise or counterclockwise. Further, while the number of ribs may be increased or decreased, its is preferred for liquid flow symmetry and balance to have the ribs equally spaced and similarly styled.

The fact that each of the six ribs (vanes) has a substantially uniform height is important because these ribs define the cone-to-cone spacing between adjacent cones 43. In effect, the sixty-three cones stack one on top of the other as illustrated in FIG. 2. The clearance left between adjacent cones is created by the ribs such that the ribs of one cone are in contact with the outer surface of the adjacent cone which is geometrically positioned therebeneath.

The inside surface area of wall 89 which exists between and around each rib 91–96 provides the flow path for the liquid which is being cleaned. The six flow clearance holes 98 are equally spaced around wall 89. As will be appreciated from the FIG. 2 illustration, the degree of separation between adjacent cones is extremely small (0.02–0.03 inches), noting that the height of each rib 91–96 is likewise and correspondingly quite small. In order to assist in the prevention of any of the cones collapsing or deflecting into contact with an adjacent cone along any portion of the cone surface area between the ribs, a larger number of small raised protuberances or bumps 99 are provided. The height of each bump 99 is substantially the same as the height of each rib 91–96. Although the spacing and location of bumps 99 may appear to be random, the same general pattern, although random in some respects, is repeated six times around wall 89 in order to balance their supportive pattern throughout wall 89. If a fewer number of cones are used to fill the desired space in bowl 21, then the gap between adjacent cones (i.e. their separation distance) will increase. It is anticipated that separation distances between cone bodies of between 0.02 and 0.30 inches will be acceptable.

The innermost edge of each clearance hole 98 is positioned so as to be axially aligned with outer wall portion 73 of top plate 46. In this way the liquid which flows over the outer edge of top plate 46 will flow downwardly into the flow holes 98. From there the liquid travels upwardly and inwardly between adjacent cones toward openings 90. The direction of travel between adjacent cones also has an angular component due to the curved (helical) nature of ribs 91–96 which define the available flow channels or vanes between adjacent cones. When the openings 90 are reached the flow begins an axially downward path through bottom plate 47 arid on to the nozzle orifices 34 and 35 (note the FIG. 2 flow direction arrows).

Figure 10:
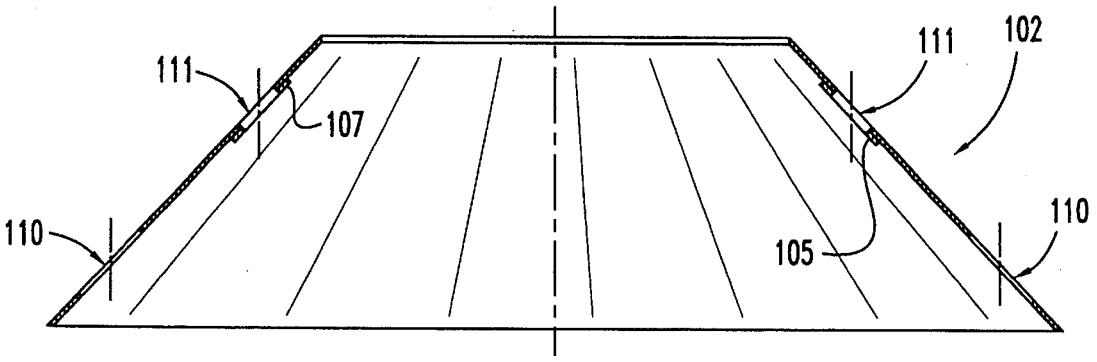
FIG. 10 is an enlarged front elevational view in full section of the FIG. 9 truncated cone as viewed in the direction of arrows 10—10 in FIG. 9 and inverted to agree with the FIG. 2 orientation.
Figure 9:
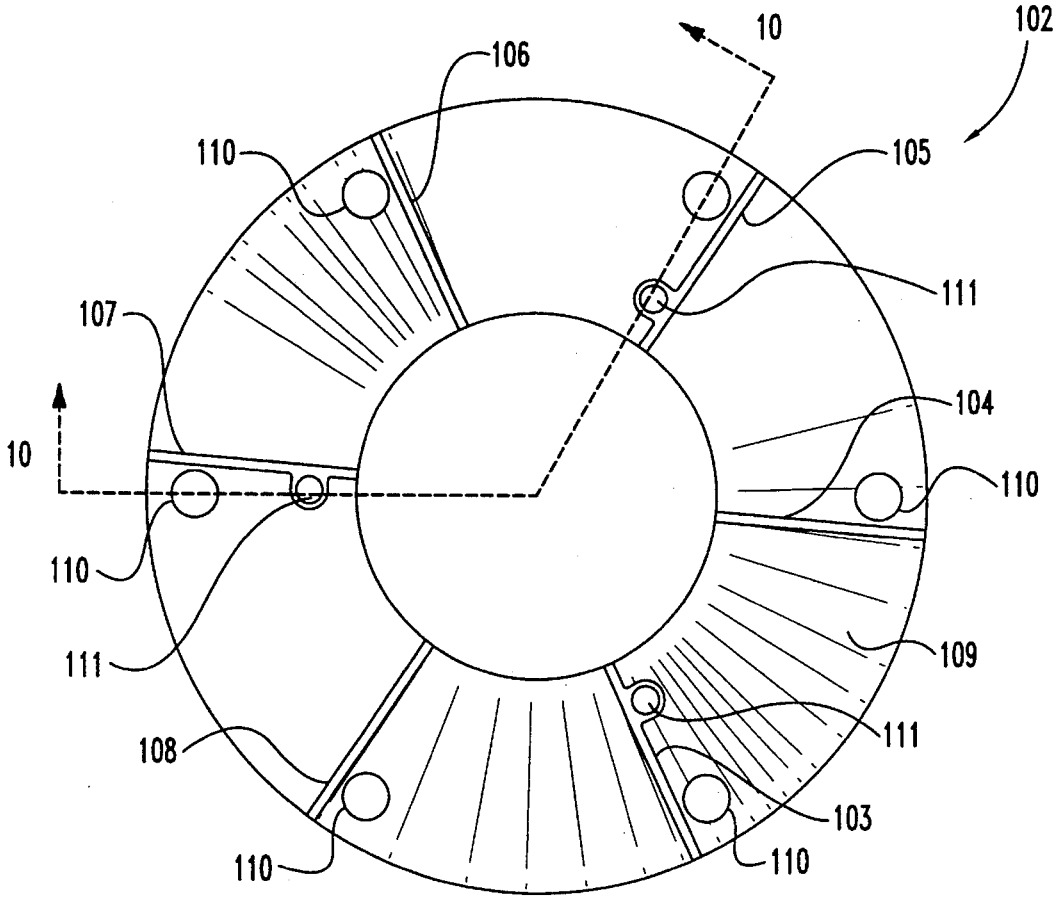
FIG. 9 is a bottom plan view of a truncated cone which may be used as one portion of the FIG. 2 centrifuge according to the present invention.

Referring to FIGS. 9 and 10 an alternative style of truncated cone 102 is illustrated. FIGS. 9 and 10 are intended to correspond generally to the arrangement of views seen with FIGS. 7 and 8. FIG. 9 is a bottom plan view and FIG. 10 is a sectional view which has been inverted so as to agree with the cone orientation of FIG. 2. The features on the back side inner surface have been omitted for drawing clarity. Cone 102 includes six straight radial ribs 103–108 which are equally spaced across the conical surface 109 of cone 102. The six flow holes 110 are equally spaced on the same diameter and the three mounting holes 111 are also equally spaced though located at a small diameter. Cone 102 is a suitable replacement for each of the sixty-three cones 43 arranged into stack 42. By using straight ribs the direction of rotation of cone 102 may be either clockwise or counterclockwise.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A bypass circuit centrifuge which is constructed and arranged to be assembled within a cover assembly for separating particulate matter out of a circulating liquid, said centrifuge comprising:

a centrifuge bowl constructed and arranged to rotate about an axis;

a base plate assembled to said centrifuge bowl, said base plate including at least one tangential flow nozzle for creating an exit flow jet said exit flow jet causing the centrifuge bowl to rotate;

a hollow centertube axially extending through said base plate and through said centrifuge bowl;

a flow-control plate positioned adjacent a first end of said centertube;

a support plate spaced apart from said flow control plate and positioned adjacent said base plate; and a plurality of truncated cones positioned into a stacked array which is sandwiched between said flow control plate and said support plate, said plurality of cones being constructed and arranged so as to define a plurality of fluid flow paths from a first opening to a second opening which is located radially inward from said first opening, said fluid flow paths being in flow communication with said at least one tangential flow nozzle.

2. The bypass circuit centrifuge of claim 1 wherein said hollow centertube includes a plurality of flow inlets for directing an entering flow of liquid toward said flow-control plate.

3. The bypass circuit centrifuge of claim 2, wherein said flow-control plate includes a plurality of flow apertures arranged fluid communication with said plurality of flow inlets.

4. The bypass circuit centrifuge of claim 3 wherein said centrifuge bowl includes an inner surface which defines a plurality of ribs, said flow control plate being positioned adjacent said ribs and arranged therewith to define a plurality of fluid flow channels.

5. The bypass circuit centrifuge of claim 3 wherein said flow-control plate includes a plurality of raised ribs, said flow-control plate raised ribs being positioned adjacent an inner surface of said centrifuge bowl so as to define a plurality of fluid flow channels between said flow-control plate and said inner surface.

6. The bypass circuit centrifuge of claim 1 wherein each truncated cone of said plurality of truncated cones includes a plurality of mounting holes.

7. The bypass circuit centrifuge of claim 6 wherein said flow-control plate includes a plurality of mounting holes.

8. The bypass circuit centrifuge of claim 7 wherein said support plate includes a plurality of mounting holes.

9. The bypass circuit centrifuge of claim 8 which further includes a plurality of mounting rods each of which extends through said plurality of truncated cones and is received by the mounting holes in said flow-control plate and in said support plate.

10. The bypass circuit centrifuge of claim 9 wherein each of said plurality of truncated cones includes a plurality of ribs which define a cone-to-cone spacing in said stacked array.

11. The bypass circuit centrifuge of claim 1 wherein said centrifuge bowl includes an inner surface which defines a plurality of ribs, said flow-control plate being positioned adjacent said ribs and arranged therewith to define a plurality of fluid flow channels.

12. The bypass circuit centrifuge of claim 1 wherein said flow-control plate includes a plurality of raised ribs, said flow-control plate raised ribs being positioned adjacent an inner surface of said centrifuge bowl so as to define a plurality of flow channels between said flow-control plate and said inner surface.

13. The bypass circuit centrifuge of claim 1 wherein each of said plurality of truncated cones includes a plurality of ribs which define a cone-to-cone spacing in said stacked array.

14. The bypass circuit centrifuge of claim 1 wherein said flow control plate has an annular body portion and an annular flange portion, said annular body portion defining a hollow interior and having an annular lip adjacent one end of said annular body portion, said annular lip being assembled into sealing relationship with an outer surface of said hollow centertube.

15. The bypass circuit centrifuge of claim 14 wherein said annular body portion includes an annular inner wall and an annular clearance region positioned between said annular lip and said annular inner wall.

16. The bypass circuit centrifuge of claim 15 wherein said hollow centertube includes an outer wall and at least one fluid flow inlet aperture extending through said outer wall, said fluid flow inlet aperture opening into said annular clearance region.

17. A bypass circuit centrifuge for use in combination with a cover assembly and axial shaft and comprising:

a centrifuge bowl constructed and arranged to rotate about an axis, having a partly closed first end defining a centrally positioned aperture therein and an open second end;

a base plate assembled to said second end of said centrifuge bowl, said base plate including at least one tangential flow nozzle for creating an exit flow jet, said exit flow jet causing the centrifuge bowl to rotate;

a flow tube extending axially through said base plate and through the aperture in said first end of said centrifuge bowl, said flow tube including a flow passageway;

a space-apart of support plates including a first support plate position adjacent said aperture and a second support plate which is assemble into said base plate;

a stacked array of particular separation cones positioned around said flow tube and axially extending between said pair of support plates; and alignment means for securing together said stacked array with said pair of support plates.

18. The bypass circuit centrifuge of claim 14 wherein said flow tube is hollow and includes an externally threaded first end extending through said centrifuge bowl aperture and a shouldered second end anchored into said base plate.

19. The bypass circuit centrifuge of claim 18 wherein said first support plate has a plurality of flow holes extending therethrough.

20. The bypass circuit centrifuge of claim 19 wherein said centrifuge bowl includes on inner surface which defines a plurality of ribs, said first support plate being positioned adjacent said ribs and arranged therewith to define a plurality of fluid flow channels.

21. The bypass circuit centrifuge of claim 17 wherein each separation cone of said stacked array includes a plurality of mounting holes.

22. The bypass circuit centrifuge of claim 21 wherein said first support plate includes a plurality of mounting holes.

23. The bypass circuit centrifuge of claim 22 wherein said second support plate includes a plurality of mounting holes.

24. The bypass circuit centrifuge of claim 23 which further includes a plurality of mounting rods each of which extends through said plurality of separation cones and is assembled into the mounting holes of said first support plate and of said second support plate.

25. The bypass circuit centrifuge of claim 24 wherein each of said plurality of separation cones includes a plurality of ribs which define a cone-to-cone spacing in said stacked array.

26. The bypass circuit centrifuge of claim 17 wherein each of said plurality of separation cones includes a plurality of straight, radial ribs which define a cone-to-cone spacing in said stacked array.

27. The bypass circuit centrifuge of claim 26 wherein each of said plurality of separation cones further includes a plurality of raised protuberances.

28. The bypass circuit centrifuge of claim 17 wherein said first support plate having an annular body portion and an annular flange portion, said annular body portion defining a hollow interior and having an annular lip adjacent one end of said annular body portion, said annular lip being assembled into sealing relationship with an outer surface of said flow tube.

* * * * *

UNITED STATES PATENT AND TRADEMARK OFFICE
CERTIFICATE OF CORRECTION

PATENT NO. : 5,575,912

DATED : November 19, 1996

INVENTOR(S) : Peter K. Herman, et al.

It is certified that error appears in the above-identified patent and that said Letters Patent is hereby corrected as shown below:

On the title, item

[73] (Assignee), replace "India." with --Tenn.--.

In Col. 6, line 43, replace "exit" with --exits--.
In Col. 7, line 43, replace "Lop" with --top--.
In Col. 7, line 47, replace "arid" with --and--.
In Col. 8, line 39, replace "arid" with --and--.
In Col. 10, line 25, replace "arid" with --and--.
In Col. 11, line 16, after "arranged" insert --in--.
In Col. 12, line 19, after "spaced-apart" insert --pair--.
In Col. 12, line 20, replace "position" with --positioned--.
In Col. 12, line 21, replace "assemble" with --assembled--.
In Col. 12, line 22, replaced "particular" with --particle--.

Signed and Sealed this

Eighth Day of July, 1997

Bruce Lehman

*Attest:*

BRUCE LEHMAN

*Attesting Officer*

*Commissioner of Patents and Trademarks*